United States Patent [19]

Froelich

[11] 4,119,150

[45] Oct. 10, 1978

[54] METHOD FOR TREATING WELL BORES AND APPARATUS THEREFOR

[76] Inventor: Mark Stayton Froelich, 4400 Memorial, #2164, Houston, Tex. 77007

[21] Appl. No.: 762,025

[22] Filed: Jan. 24, 1977

[51] Int. Cl.[2] ..... E21B 43/02

[52] U.S. Cl. ..... 166/276; 166/51; 166/69

[58] Field of Search ..... 166/295, 294, 300, 276, 166/228, 309, 51, 57, 67, 63, 90, 69, 169, 72, 168

[56] References Cited

U.S. PATENT DOCUMENTS

| | | | |
|---|---|---|---|
| 2,761,511 | 9/1956 | Billue | 166/295 X |
| 2,837,032 | 6/1958 | Horsting, Sr. | 166/227 UX |
| 3,099,318 | 7/1963 | Miller et al. | 166/227 |
| 3,137,346 | 6/1964 | McLennan | 166/276 |
| 3,153,449 | 10/1964 | Lebourg | 166/295 X |
| 3,346,049 | 10/1967 | Brown | 166/295 X |
| 3,379,253 | 4/1968 | Chism | 166/295 |
| 3,470,957 | 10/1969 | Hamilton | 166/295 |
| 3,637,019 | 1/1972 | Lee | 166/295 |
| 3,692,116 | 9/1972 | Sparlin | 166/295 |
| 3,727,691 | 4/1973 | Muecke et al. | 166/295 |
| 3,782,466 | 1/1974 | Lawson et al. | 166/295 X |
| 3,878,686 | 4/1975 | Hageman et al. | 166/295 X |

*Primary Examiner*—Stephen J. Novosad
*Attorney, Agent, or Firm*—David M. Ostfeld

[57] ABSTRACT

The method and apparatus of the invention involves treatment of a subterranean site, i.e., the producing sand sites, in a well bore to prevent infiltration of subterranean solids into the well bore or to stabilize or modify the area surrounding a portion of the well bore. Said invention includes the local injection of a selective substantially occluding quantity of a curable resin foaming material from a source located at the subterranean site. Said material, upon curing, forms a substantially chemically and dimensionally stable porous resin mechanically rigid occluding structure which is permeable to liquids and gases while same is impermeable to solids. After injection, the foaming material will cure in situ to form the above-mentioned structure at the subterranean site. The source of said invention may be provided as a remotely actuable self-contained suspendable charger-mixer-injector device which may be lowered into the well bore and contains a supply of precursor ingredients for producing the curable resin foaming material.

29 Claims, 12 Drawing Figures

METHOD FOR TREATING WELL BORES AND APPARATUS THEREFOR

BACKGROUND OF THE INVENTION

This invention relates to a method and apparatus for treating a subterranean site of a well bore. Specifically, said invention relates to the in situ formation of a resin foam structure at the subterranean site by use of a device which locally generates and delivers a curable resin foaming material at said site.

The infiltration of sand into a well bore at the subterranean site is found to be a large problem for the oil industry. Said infiltration occurs as small solids move from the producing formation to the well bore along with the liquids or gases. At some point in time, the flow of solids into the well bore can restrict the productive capacity by blocking the perforation of the casing or conventional slotted screens or liners therein, may even cause the loss of said productive capacity, and can damage the production equipment.

Conventional techniques for solving the problem include plasticizing at the site or the use of slotted liners or screens or gravel packs. Plasticizing is of little benefit if the subterranean site has unconsolidated sands that will not adhere to the plasticizing chemicals. Use of liners, screens or gravel packs is not generally satisfactory and the combined use of such devices can result in very expensive efforts when attempts are made to remove the devices for the purpose of workovers.

DESCRIPTION OF THE PRIOR ART

In U.S. Pat. No. 2,941,594, a filter is formed at the subterranean area by inserting into the well bore a composition of resin coated particulate solids which are suspended in a carrier liquid, said resin setting in situ to form a rigid fluid-permeable barrier to the passages of solids. U.S. Pat. Nos. 3,137,346; 3,776,311 and 3,929,191 also involve supplying a resin substance from a remote source to the subterranean area in question for hardening. U.S. Pat. No. 3,587,741 involves the delivery of pellets from ground level to the subterranean area through perforations in the well bore, wherein said pellets force the subterranean formation away from the well bore and form a pellet filter around the well bore. None of the above-mentioned patents teaches the use of an in situ production of a resin foam structure at the subterranean site with the curable resin foaming material being locally generated and delivered in a uniformily consistent and homogeneously nascent, curable mass.

SUMMARY OF THE PRESENT INVENTION

The present invention is a novel method and apparatus for treating a subterranean site of a well bore which involves the local generation and delivery of a uniformly consistent, homogeneously nascent, curable, resin foaming material, i.e., an in situ production of the foaming material at the desired subterranean site, for prevention of the movement of solids into the well bore.

Therefore, one of the objects of the present invention is to provide an efficient apparatus or method for treating a subterranean site in a well bore so as to prevent the movement of solids which are located near the well bore.

Another object of the present invention is to provide an efficient apparatus or method for preventing the movement of solids into the well bore casing along with the fluids or gases which are being taken from the subterranean site.

Still another object of the present invention is to provide an efficient apparatus or method for stabilization of a subterranean void which might be located adjacent to the well bore.

Yet another object of the present invention is to provide said resin foaming material in a substantially chemically and dimensionally stable porous resin foam mechanically rigid occluding structure which is permeable to liquids and gases, but not solids.

Yet another object of the present invention is to provide a remotely actuable, suspendable charger-mixer-injector device which has a chargeable supply of precursor ingredients for producing a curable resin foaming material and which may be lowered through the well bore to the desired site for locally generating and delivering an occluding quantity of curable resin foaming material in the form of a readily flowable, substantially uniformly consistent, homogeneously nascent, curable gas-liquid phase mixture to the desired site under selective operative elevated delivery pressure to permit in situ curing to form a porous occluding structure.

Yet another object of the present invention is to provide said remotely actuable, suspendable charger-mixer-injector device with a flow connection, by use of feed lines, to a replenishing main supply of the precursor ingredients to replenish the chargeable supply as needed without retrieving the device from its subterranean location, said main supply located at the top of the well bore.

Further objects, advantages and features will become more apparent from the detailed disclosure to follow.

DESCRIPTION OF THE PREFERRED EMBODIMENT

Figure 3:
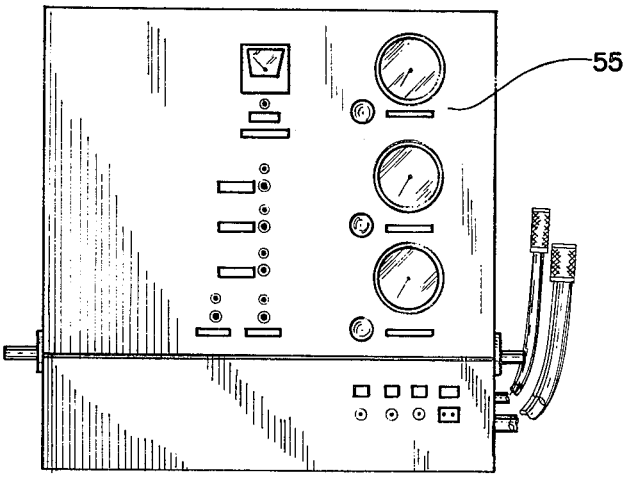
FIG. 3 is the front view of the injector control panel.

In the preferred embodiment of the present invention, a new method for preventing and controlling the movement of sand, fines and similar solids in the subterranean site of a well bore at a lower cost and with less effort is described. The present invention prevents the migration of solids into the well bore casing and may be used to fill and stabilize surrounding voids in the formation. The ingredients contemplated for use in the present invention may be provided by a local or physically immediate source which may in turn be provided by way of a durable, compact and self-contained charger-mixer-injector device according to the invention which is capable of generating and delivering the method ingredients at the local treatment site.

A method for treating a subterranean site in a well bore comprising the local injection at the subterranean site into the well bore of a substantially occluding quantity of a curable resin foaming material which, upon curing, forms a substantially chemically and dimensionally stable porous resin foam which constitutes a mechanically rigid occluding structure which is permeable to liquids and gases yet prevents the passage of subterranean particulate solids. This injected resin foaming material cures in situ at the subterranean site and produces a porous resin foam structure at the site. The ability of the structure to allow liquids and gases to pass therethrough while inhibiting the passage of solids is due to the permeable nature and properties of the in situ formed porous foam structure. Its nature, therefore, gives it particulate solid screening ability. The plugging of the well bore casing can thus be affected either internally or externally in the form of a low cost operation. The decision to form a foam structure in the well bore casing internally or externally will determine the alignment of the charger-mixer-injector device with respect to the casing. Establishing a foam structure in the well bore casing in an external manner, in addition to providing the protective filter structure, also allows for the structural stabilization of the formation area surrounding the well bore subterranean site. This structure also fills in voids which may occur thereat. By delivering the foaming material outwardly beyond the well bore casing or downwardly through the open end of the casing, any voids can be effectively filled and the particular formation thereat can be impregnated with foaming material to stabilize the same upon curing.

One of the significant features of the present invention is the ability to generate and deliver locally from a source at the subterranean site the required quantity of the foaming material for occluding or establishing a permeable foam plug in the flow zone into the well bore or filling and stabilizing the surrounding exterior formation area after the foaming material is cured in situ.

The invention provides a chargeable local supply of the precursor ingredients for producing the curable resin foaming material in a compact self-contained manner, permitting lowering of the device through a well bore to the subterranean site for remote actuation thereof to charge, mix and inject the local supply under such selective operative elevated delivery pressure as may be necessary or desirable. If desired, the device may be flow-connected by way of feed lines with a replenishing main supply of the precursor ingredients remotely located at the upper end of the well bore for the purpose of replenishing the local supply without the necessity of retrieving the device.

Figure 1:
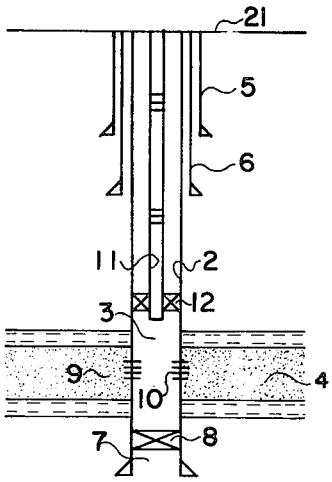
FIG. 1 is a schematic well bore diagram.

FIG. 1 illustrates the general positional environment of the charger-mixer-injector device 1 of the invention in a well bore 2 at a subterranean site 3 which is surrounded by an underground petroleum deposit formation containing a stratum of producing sand 4. The well bore 2 contains one or more outer casings 5 and 6 concentrically arranged therein which extends downwardly from the upper end of the well bore. The number and arrangement of the outer casings 5 and 6 is dependent upon various items including the particular formation, its location, depth and purpose. An inner or producing casing is located within the outer casings and is shown in FIG. 1 to be identical with the well bore 2.

The inner casing extends through the producing sand 4 and may be capped or plugged at its lower end 7 by a seal 8 which may be provided in a well known manner. Casing 2 contains a perforated zone 9 which extends along the stratum of the producing sand 4. Perforations 10 in the perforated zone 9 are situated for direct flow communication with the surrounding subterranean area to allow the flow of the desired oil or gas into the subterranean site 3. The flow of oil or gas from the producing sand 4 to the subterranean site 3 exits from the subterranean site 3 by way of the flow pipe 11. An annular plug or seal 12 is located at the lower end of the flow pipe 11 to prevent an upward flow of the oil or gas other than through the flow pipe 11.

Figure 7:
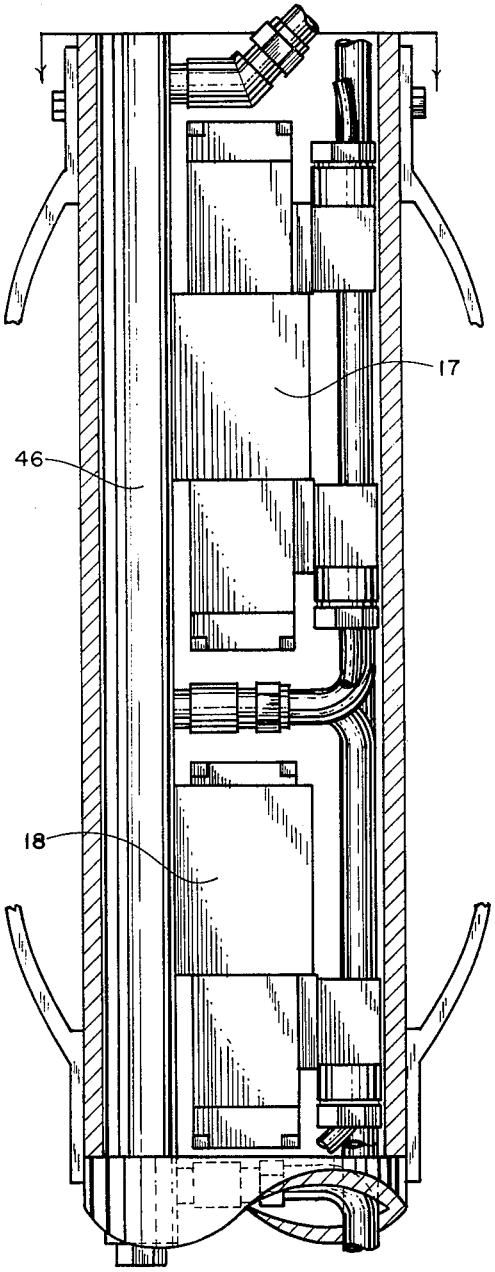
FIG. 7 is a partial cross section of a portion of the charger-mixer-injector device which shows a second solenoid operated valve for the other precursor ingredients, a solenoid operated valve for pressurized gas and a portion of the subplate to which said valves are attached.
Figure 6:
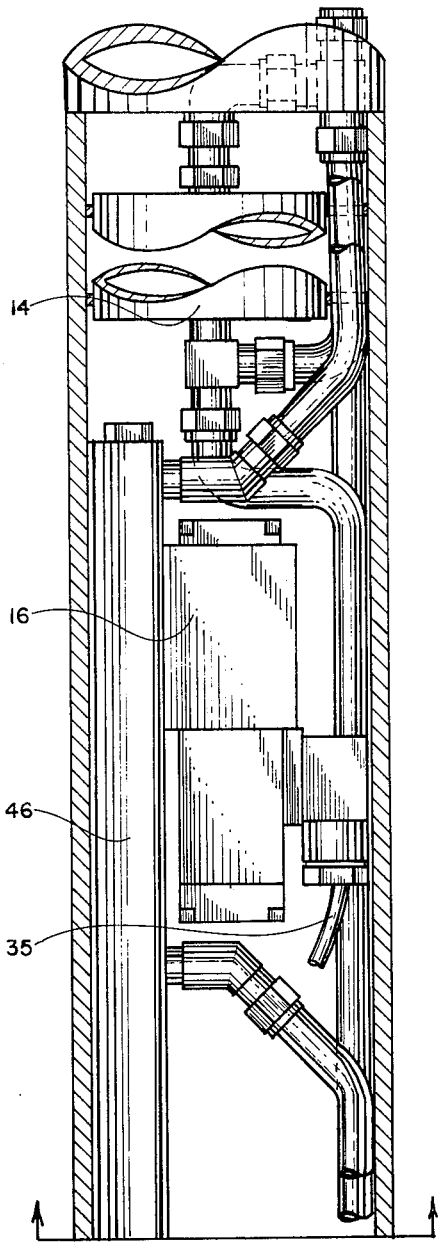
FIG. 6 is a partial cross section of a portion of the charger-mixer-injector device which shows a second accumulator for one of the precursor ingredients, a solenoid operated valve for one of the precursor ingredients and a portion of the subplate to which said valve is attached.
Figure 8:
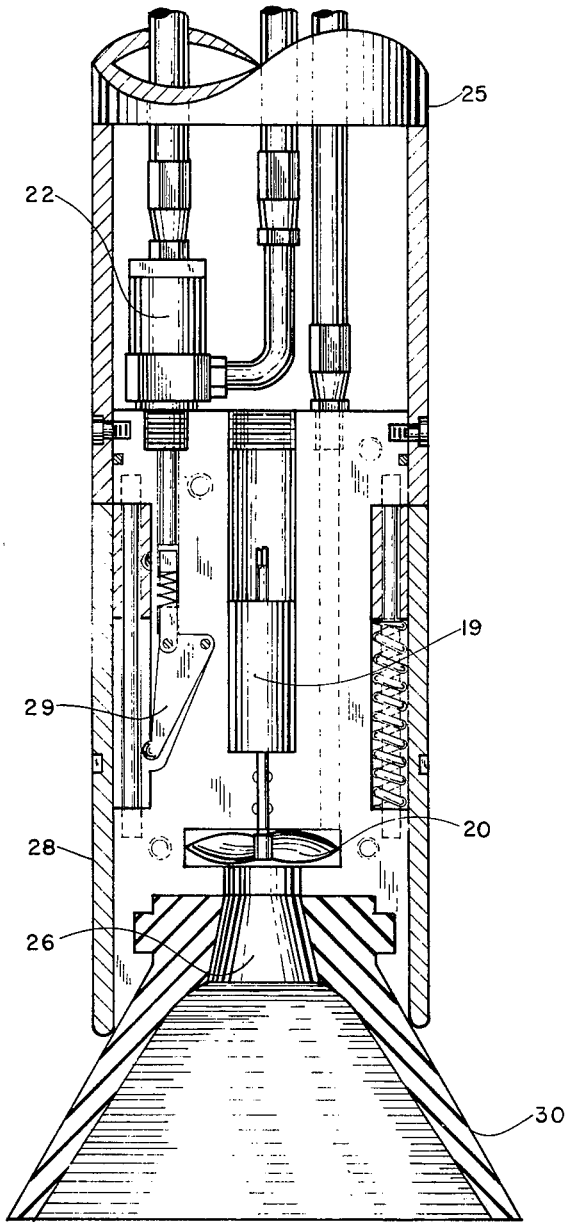
FIG. 8 is a partial cross section of the mixing means, sealing means and the release means for the sealing means.

As shown in the drawings, one version of the charger-mixer-injector device 1 may be a basically cylindrical self-contained suspendable capsule of a diameter small enough to permit lowering and raising of the capsule on a wire line through casing 2 with sufficient clearance with respect to the inner diameter of casing 2 to prevent binding or jamming therewith during travel through the casing. The charger-mixer-injector device 1 will contain a remotely controllable chargeable local supply of the precursor ingredients and means for effecting the immediate on site generation and local injecting of the curable resin foaming material for treating the selective subterranean well bore area. The internal arrangement of elements includes remotely actuated means to charge, mix and inject the local supply at the local site under selectively operative elevated delivery pressure. Liquid reservoirs 13 and 14 are shown as accumulators of such volume and size as to provide a sufficient amount of the precursor ingredients as necessary for generating a given occluding quantity of the curable resin foaming material for the intended treatment. Likewise, the charging pressure fluid gas reservoir 15 will be provided as a pressure tank of such volume and size as to contain the required amount of charging pressure fluid to achieve the desired performance of the device. The various charging elements are generally closably flow connected in a network permitting remote control actuation and operation thereof. Thus, in reference to FIGS. 6–8, means 16, 17 and 18 may be provided as solenoid operated two or four way direct current pilot operated valves such as conventional spool valves, while means 19 and 20 may be correspondently provided as an electric motor 19 operated impeller mixer 20 connected via motor lines to a remote source of power and the control panel of FIG. 3 which may be located at the upper end 21 of the well bore 2 of FIG. 1.

By actuating the charging pressure supply valve 17, the charging pressure fluid, e.g., any inert or safety gas, may be supplied from the charging pressure fluid 15 tank via tubing to each of the accumulators 13 and 14 while also flowing through one way check valves 23 and 24, respectively, to prevent reverse flow. Such configuration will maintain the supply of precursor ingredients and accumulators 13 and 14 under common charging pressure which corresponds to the pressure in tank 15. Upon actuating the motor operated impeller 20 and then the precursor ingredients-supply valves 16 and 18, said ingredients will be supplied under charging pressure from accumulators 13 and 14 by way of tubing to the mixing means 20 where they will be inner-mixed and combined to generate the desired curable resin foaming material.

The mixer-head 25 may be provided in the form of a nozzle having a portion thereof defining an exit mouth 26 which extends outwardly at the lower portion of the capsule. Means 22 may be provided as a piston-cylinder arrangement operatively connected to the cone protector sleeve 28 by way of a spring return dog catch 29 and energized by pressure fluids supplied under charging pressure from a pressure fluid tank through tubing upon actuation of injector means control valve 17. The piston-cylinder arrangement 22 may be preliminarily energized by actuation of control valve 17 before the start of the foaming operation in order to position the nozzle 30 in the well bore in an operatively expanded, selective manner to achieve proper delivery of foaming means to effectuate the intended treatment method. As an example, by utilizing an expandable resiliant cone of neoprene as the nozzle 30 and mounting an axially reciprocal sleeve 28 at the lower end of the capsule control by the operation of the piston-cylinder arrangement 22 and outwardly extendable to squeeze the exit mouth 26 of the cone, the capsule may be lowered in casing 2 and located and fixed in the subterranean site 3 while the exit mouth 26 is in a squeezed-over condition, whereupon the sleeve 28 can be retracted by remote actuation of control valve 17 and operation of piston-cylinder arrangement 22 to release the nozzle 30 and enable it to expand to its operative position. Said position may be in full peripheral engagement along the edge of the exit mouth 26 with the surrounding flow pipe 11, casing 2 or other well bore site as the case may be.

Figure 2:
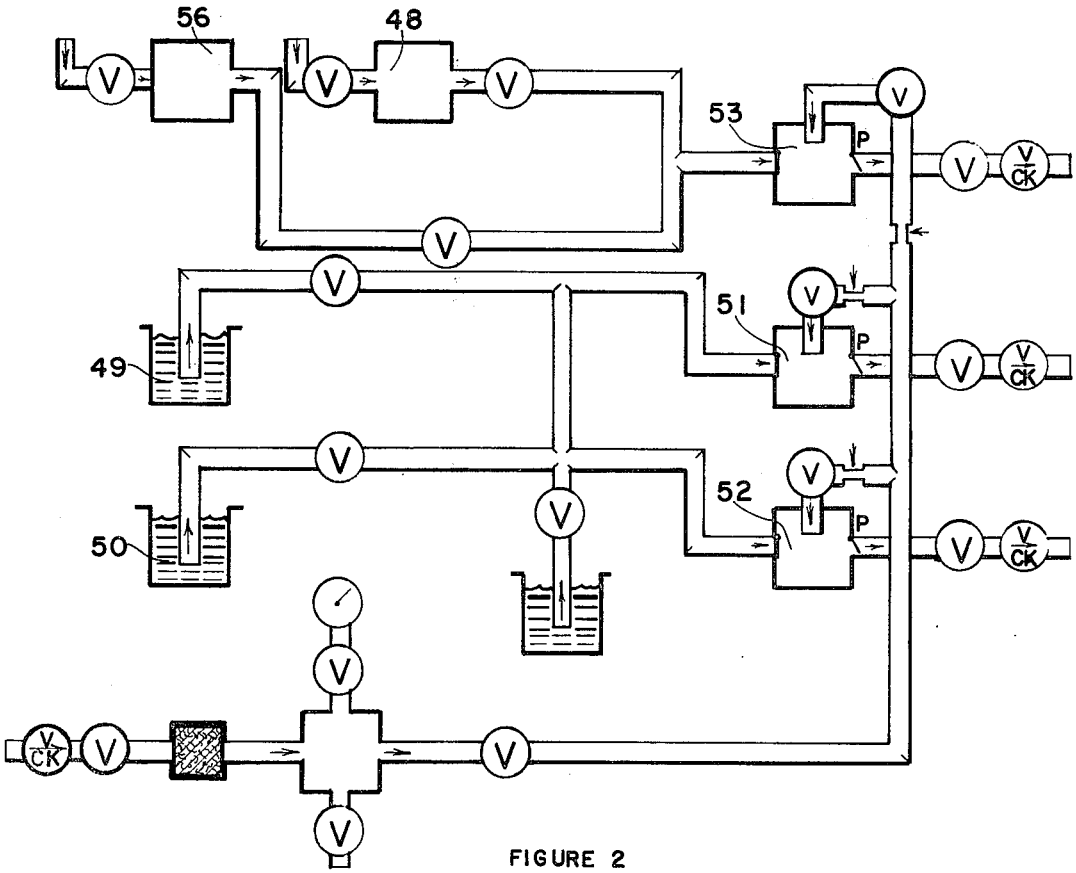
FIG. 2 is a schematic diagram of the chemical loader.
Figure 5:
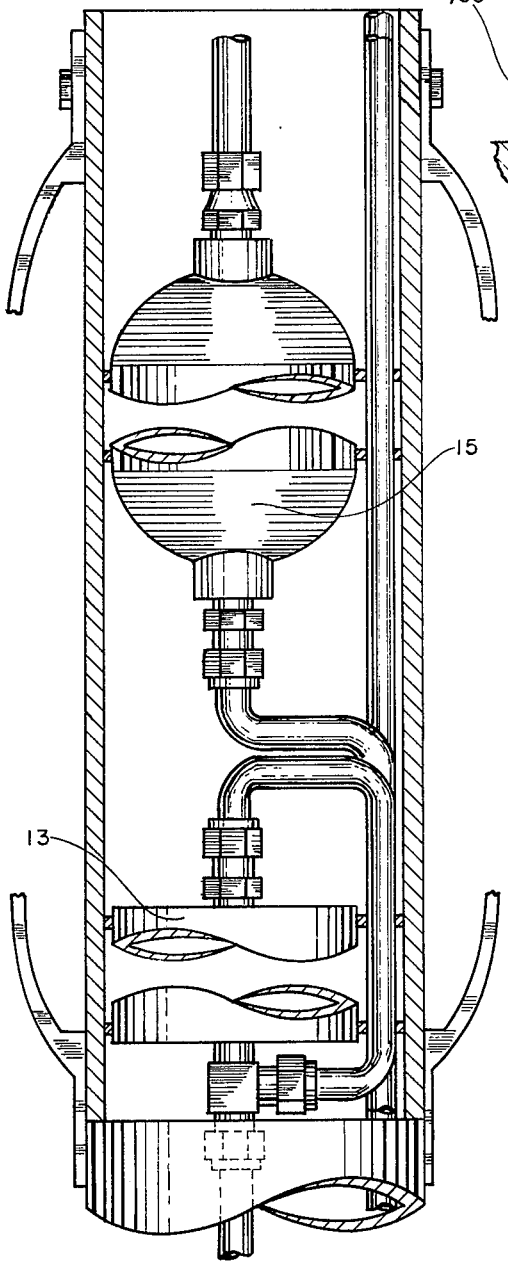
FIG. 5 is a partial cross section of a portion of the charger-mixer-injector device which shows the pressurized gas tank and an accumulator for one of the precursor ingredients.
Figure 4:
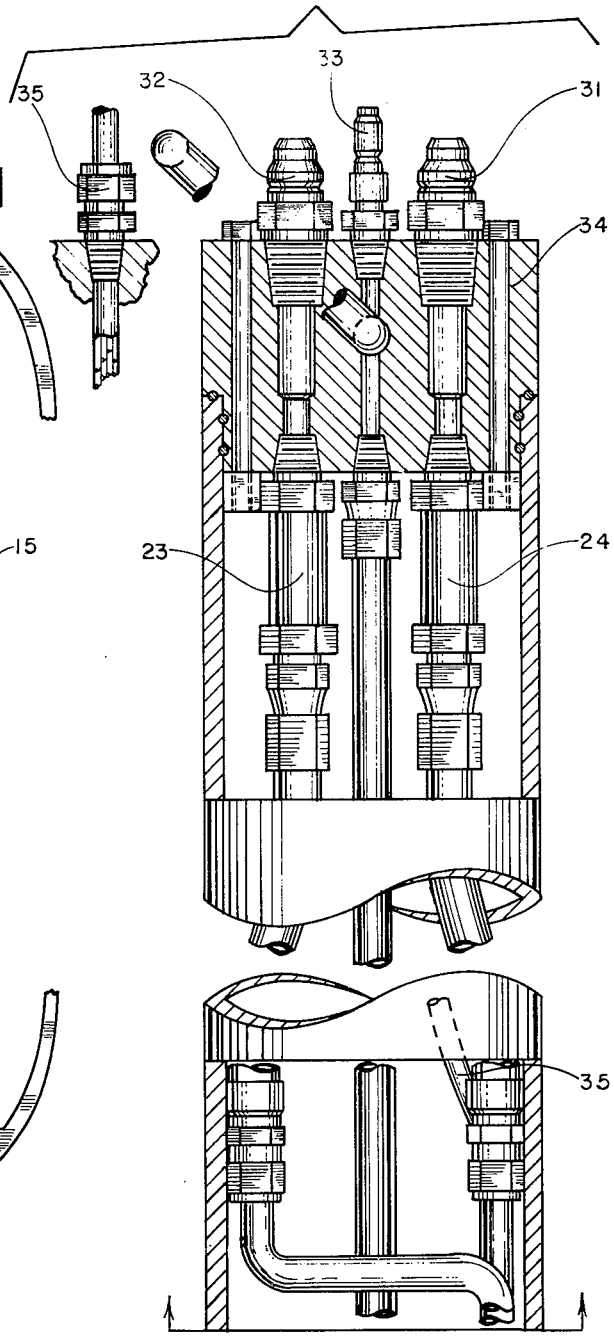
FIG. 4 is a partial cross section of the loading end of the charger-mixer-injector device.

The charger-mixer-injector device 1 may be provided with check valve equipped feed line connector means 31, 32 and 33, such as quick disconnect lines equipped with respective one-way check valves to prevent reverse flow, to replenish the precursor ingredients in liquid tanks 13 and 14 and the pressure fluid in gas tank 15 as the case may be. Preferably, the disconnect lines for means 31, 32 and 33 are positioned at the upper end of the capsule for ready reception of enclosable flow connection with appropriate feed lines which would lead up the well bore 2 to a replenishing main supply (see FIG. 2) of the precursor ingredients and pressure fluid remotely located at the upper end 21 of the well bore. This addition allows the precursor ingredients 49 and 50 and pressure fluid 48 to be replenished in situ without having to retrive the charger-mixer-injector device 1. The device 1, however, can operate without the remote recharger device. Device 1 will also be provided at its upper end 34 with an electrical conduit feed line 35 to a power source 55 at the upper end of the well bore 21 for controlling valves 16, 17 and 18 and the motor operated impeller 20.

After the device 1 has been located and fixed in proper position in the subterranean site 3 via its suspending wire line, valve 17 may be actuated remotely to energize piston-cylinder arrangement 22 via nitrogen or other appropriate gas under charging supply of pressure from tank 15 to retract the cone-enfolding sleeve and thus release the cone 30 into full outward sealing engagement at its periphery with the surrounding internal wall of casing 2 for example. At any time, but preferably at or after the occurrence described in the preceding sentence, valve 17 may be actuated remotely to place accumulators 13 and 14 under the common charging supply pressure of the gas in tank 15. The gas acts as a pressure head at the gas-piston-liquid innerfaces of accumulators 13 and 14. Consequently, upon remote actuation thereafter of the motor operated impeller 20 and the valves 16 and 18, the precursor ingredients in accumulators 13 and 14 will be fed under corresponding elevative pressure to the chamber of the mixing means 19 and 20 for innermixing and for generating the curable resin foaming material which in turn is conveyed under such elevative pressure through the nozzle 30 and into the subterranean site 3.

Accumulators 13 and 14 will be sized to provide a selective substantially occluding quantity of the foaming material sufficient to fill the void in question so that upon curing in situ a desirous porous resin foam structure will be formed, said foam structure being substantially chemical and dimensionally stable, generally inert to petroleum, oil and gas, water and brine, and constituting a porous resin foam mechanically rigid occluding structure which is permeable to liquids and gas while preventing the passage of solids. If the foam structure is placed in the subterranean site 3, the size and position of the foam structure may be varied by an initial adjustment of the positional relationship between seal 8 and annular seal 12. Furthermore, if it is desirous to plug a void surrounding the lower end of the casing 2, seal 8 may be omitted and the foam material may be delivered so as to pass through the open end of the well bore or casing 2 and fill the adjacent void, thereby stabilizing the subterranean area. In either of the two last mentioned uses of the rigid permeable or impermeable foam plug, said plug may be simply drilled out, if necessary, in a much less complex workover than that involved in fishing for a presently commercially used gravel packed liner or the like and the relative hardware used in some conventional techniques. The present invention can be used to fill any voids occuring in the producing sand 4 radially outwardly from the well bore 2 by placing seal 9 and annular seal 12 closely adjacent to the perforations 10 or any portion thereof and locating cone 30 immediately adjacent to the unsealed perforations under suitable elevative charging supply pressure provided selectively by the gas in tank 15 acting on the liquids in accumulators 13 and 14. The delivered foaming material will be injected through the perforations readily outwardly into the surrounding area of the producing sand to fill the above-mentioned voids and corresponding stabilization of the immediate void area will also be achieved. This technique provides a way for effectively and economically reducing the probability of failure resulting from the otherwise production and migration of sand.

In order that the proportions of the precursor ingredients in accumulators 13 and 14 may be readily matched or adjusted for any desired mixing ratio, valves 16, 17 and 18 can be conveniently provided as selectively remotely controlled valves for metering gas or liquid at an adjustable or predeterminable flow rate of volume. The motor operated impeller 65 may be provided as an infinitively variable speed motor operated impeller which is selectively remotely controllable in relation to the rate of feed of the precursor ingredients thereto. In order to form occluding plugs externally of the casing 2 for filling voids and stabilizing the surrounding sand formation area 4, provision is made for selectively charging the gas accumulator 15 to a higher range of elevated pressure so that the generative curable resin foaming material can be delivered at correspondently elevated pressures. By providing feed lines for replenishing the local charging supply of precursor ingredients 49 and 50 and nitrogen gas 48 from a main supply at the upper end 21 of the well bore 2, the desired gas pressure can be constantly maintained at a high level and the precursor ingredients can be continually replenished. Such an arrangement may be provided in the form of a main supply facility FIG. 2 constituting a readily off-shore or on-shore transportable self-contained chemical loader or storage bins and related intensifiers 51, 52 & 53.

Figure 9:
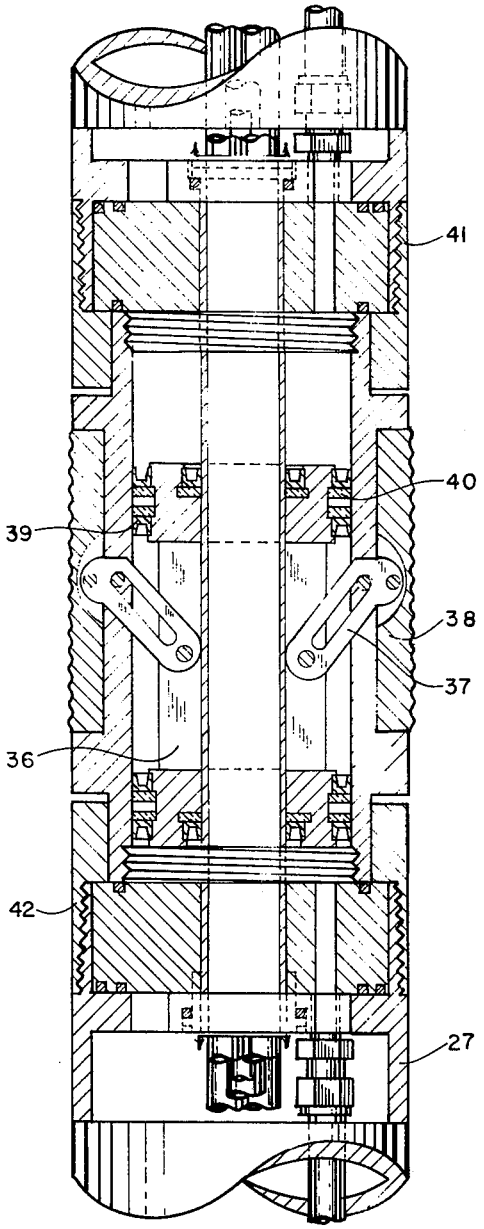
FIG. 9 is a partial cross section of the dogging mechanism.

An optional portion of the present invention is the dogging mechanism 27 shown in FIG. 9. The purpose of this portion of the invention is to secure and stabilize the invention with regard to the inner producing casing 2 once the invention has been lowered to its proper position within said casing. At same time, pressurized nitrogen or other acceptable fluid or liquid is applied to the lower side of piston 36 which forces piston 36 to translate. Said movement forces linkage or linkages 37 to move in an outwardly motion which, at the same time, forces the dogging pad or pads 38 to move outwardly and away from the invention until they come in contact with the interior side of the casing. The continued exertion of sufficient pressure upon the lower end of piston 36 will continue to result in the dogging pad or pads being firmly forced upon the interior sides of the casing. Said procedure will result in the stabilization of the entire invention within the casing. At any time the dogging pad or pads may be returned to their initial position by releasing the pressure on the lower end of piston 36 and exerting pressure in the form of nitrogen or other suitable gas or liquid upon the opposite side of piston 36. This latter exertion of pressure will force the piston 36 to translate in a reverse direction within the invention and thereby return the linkages 37 and the dogging pad or pads 38 to their original positions. Appropriate use of piston seals 39 and scraper rings 40 will prevent loss of pressure in the sections above or below the piston 36. Use of connector rings 41 and 42 at the opposite ends of the dogging mechanism allow it to be inserted into the invention at the desired position. Without limiting the position of the dogging mechanism within the invention, it is suggested that the same be placed immediately above the mixer head 25.

Figure 11:
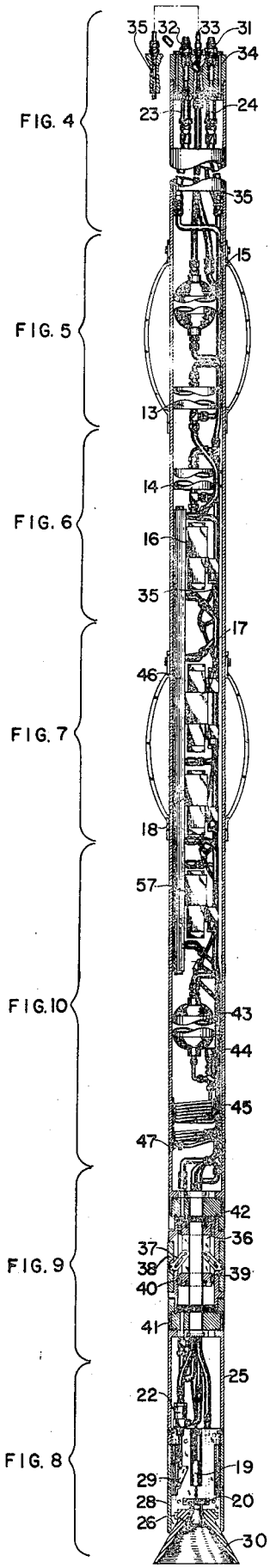
FIG. 11 is a longitudinal cross section of the charger-mixer-injector device showing the relationship of FIGS. 4–10 and the four way valve 57.
Figure 10:
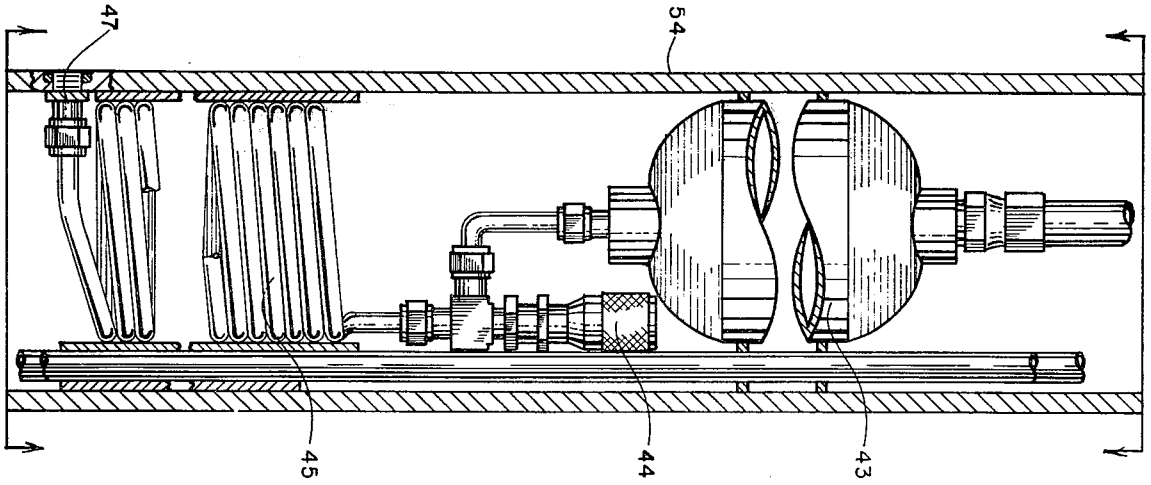
FIG. 10 is a partial cross section of the downhole tool cooling system.
Figure 12:
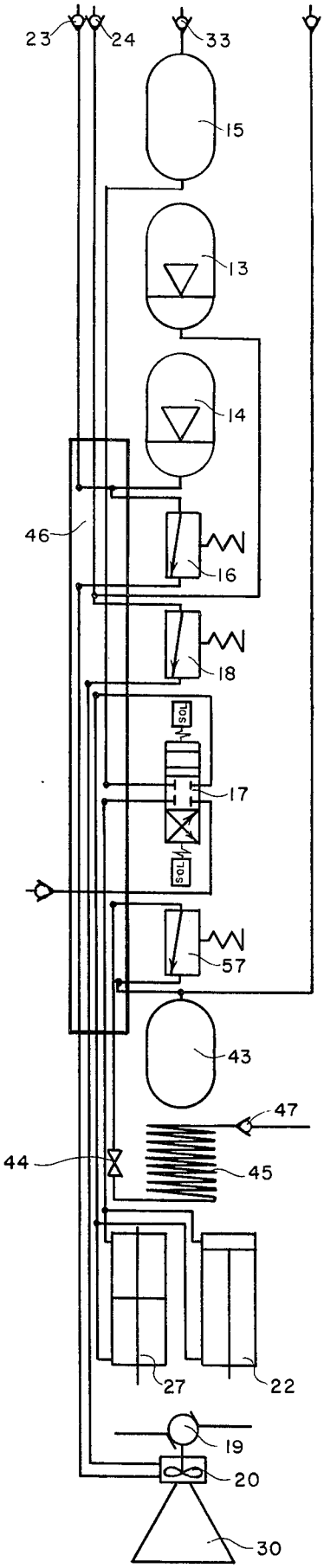
FIG. 12 is a schematic diagram of the charger-mixer-injector device showing manifold 46.

An additional section which may be added to the present invention involves a downhole tool cooling system 54. As the name indicates, said system is used to cool the internal components of the downhole charger-mixer-injector device. The theory of the downhole tool cooling system is basic and the system includes five major components which are described as follows: a pressure cylinder 43 which may be recharged from main supply cylinder 56; a metering valve 44; a coil 45 which is typical of coils found throughout the present invention and may be constructed form ⅛ inch copper tubing, although construction is not limited to said specific tubing; a two or four-way solenoid-operated valve (not shown in FIG. 10 but shown in FIGS. 11 and 12 at "57") which is added to manifold 46; and a check valve 47 which may be a subplate mounted type with a swedge tubing fitting, although construction is not limited to said specific components. The system can be used to allow metered amounts of pressurized carbon dioxide through the coil 45 and valve 47 into the fluid located in the well bore 2. As the carbon dioxide escapes to the well bore 2, an endothermic process occurs whereby heat is absorbed. The escape rate of the carbon dioxide gas can be controlled by the solenoid valve, metering valve 44 and check valve 47. The system may be remotely controlled by a wire-line cable from the surface to the solenoid valve. The metering valve 44 is used to set the rate of flow of the carbon dioxide gas. Normally, the metering valve 44 would not be remotely actuated, but rather would be set to the desired flow rate at the surface before the device 1 is lowered into the well bore 2. After the device is lowered into the well bore, the operator will be able to control the temperature of the device via the solenoid valve. A temperature transducer may be located in the tool for the purpose of displaying the temperature in the form of a meter reading on the control panel 55 to the person operating the device. Upon reading said meter, said person may release pressurized carbon dioxide through the coil 45 periodically as the need arises to allow cooling of the inner portion of the device as the temperature of the downhole environment increases.

The curable resin foaming material may be produced from any conventional available precursor ingredients capable of curing in situ to form a substantially chemical and dimensionally stable porous resin foam structure. Said structure normally should be inert to petroleum oil and gas, water and brine and should constitute a mechanically rigid occluding porous foam structure which is permeable to such liquids and gases while preventing the passage of subterranean solids such as formation sand therethrough.

Suitable types of foam materials include in situ curable phenolic or polystyrene resin foam and like types of foam. These are generally provided as two separate precursor ingredients components which, upon contact and inner mixing, generate the curable foam. Said components are reactable on contact and contemplate a foamable, curable resin and a catalyst and foaming agent therefor. A volatile catalyst may be provided as a chemical foaming agent in the conventional manner and in the usual amounts so that, under the elevated autogenous exothermic reaction temperature in the mixing chamber, the foaming agent and any condensation water will volatize and cause expanding and foaming of the inner-mixed ingredients. The chemical foaming agents may be included with or without mechanical foaming agents such as high pressure inert gas, for achieving the same type results. Chemical foaming agents are also used in the conventional manner and in the usual amounts so they self-generate gaseous products under exothermic reaction conditions to achieve the foaming of the curable resin component. Combinations of mechanical and chemical foaming agents may be employed optionally in the usual proportions to each other for achieving any particular desired properties in the resultant foam. The foaming or blowing agent may also be in the form of an inert gas such as nitrogen. By permitting some of the charging supplied nitrogen fed to the accumulators 13 and 14 from tank 15 to pass outwardly with the liquid feed to the mixing chamber of the invention, foaming may be effected in said manner as well as at the same time providing the requisite elevated pressure for efficient delivery of the foaming material to the subterranean site being treated. The generated foaming material will be conveniently injected at the subterranean site as a flowable substantially uniformly consistent homogeneous nascent curable gas-liquid phase intimate mixture under such operative elevated delivery pressure as may be desirably selected by reason of the pressure supply of the precursor ingredients under the nitrogen gas pressure head to the mixing chamber with or without the inclusion of other foaming agents or blowing agents.

The provision of a catalyst such as an acid activating catalyst for the curable resin component will allow the mass to begin its exothermic reaction at a conveniently rapid rate within the mixing chamber of the device. Said catalyst is a conventional component which may be used in the usual amounts for the prevailing conditions. When the catalyst is employed, the exothermic reaction takes place rapidly without the need to apply extraneous heat; however, a remotely actuable conventional electric heating element can be installed in the device of the invention to enhance the temperature condition. The heating element can be supplied with power from the same source that supplies the motor operated impeller 20. The catalyst may be provided in a form already admixed with the volatile catalyst in one of the precursor ingredients local supply tanks and the resin component can be provided in the other tank for inner mixing in the mixing chamber. Other possible alternatives provide that a volatile catalyst be admixed in part with the resin component in one of the local supply tanks while the remainder of such catalyst be mixed with the catalyst component in the other tank or separate partially reactive parts of the resin component can be provided in the two tanks with the catalyst being included in that tank containing the partially reactive part of the resin component which will not further react even in the presence of the catalyst so long as the remaining partially reactive part of the resin component is absent.

The foam may be composed of a phenolic base which is produced from a two part chemical system which basically constitutes a phenolic resin with a chemical or mechanical blowing agent and an acid activator catalyst. The accumulator 13 may be loaded with a viscous aqueous phenolic resole resin and accumulator 14 may be loaded with a dilute aqueous hydrochloric solution as catalyst with the water content in both accumulators serving as a foaming or blowing agent. Upon mixing the flow of the resin component from accumulator 13 with the catalyst component from accumulator 14, said combination in the mixing chamber produces an exothermic condensation reaction which produces steam. The steam and other produced reaction water from the initiated condensation reaction expand the polymerized phenolic resin. The ratio of total water to resin present in the mixing chamber mixture is selected to regulate the cell size and density of the foaming material autogenously formed. The acid catalyst causes a rapid foaming reaction and the produced foaming material is delivered from the nozzle 30 to the casing chamber at the zone 9 of perforations 10 and forms an internal plug in situ upon self curing thereat. The in situ cured product is a substantially chemically and dimensionally stable permeable resin foam structure which is inert to petroleum oil and gas, water and brine. It is sufficiently mechanically rigid to occlude completely the casing chamber and is permeable to liquids and gases while able to prevent the passage of solids including subterranean sand.

The foam formed in situ at the local subterranean site can be provided in the conventional manner with selective chemical and physical properties and characteristics by appropriate concordant adjustment of the polymerization conditions including temperatures, pressures, catalized reaction rates, feed and intermixing rates, proportions of reaction components and ordinal sequence of intermixing particular ingredients having an influence on the reaction result. The proceeding sentence, however, is not intended to limit the combination, amount, or potency of any of the aforementioned ingredients, nor the manner in which they are culminated in order to form the aforementioned permeable foam plug. The use of remotely actuable means allows for the selective adjustment of each of the foregoing reaction conditions and parameters in dependence upon the proportions, concentrations and individual nature of the inner acting components provided.

The rigid foam can have a density which varies, for example, from 0.2 to 65 lb/ft$^3$. Additionally, said rigid foam is characterized by high dimensional stability or mechanical strength for extended periods of many years at temperatures widely ranging from −33° C. to 70° C., general heat resistance of up to approximately 121° C., comparable resistance to burning, etc. Accelerated aging tests show that essentially no change in the volume of the rigid in situ cured phenolic foam structure occurs. For example, where a phenolic foam having a density of 2 lb/ft$^3$ is tested for 28 days at 70° C. under 100% relative humidity, a 0.1% volume increase results while no change in volume arose as a result of aging for 14 days at −30° C.

Relatively speaking, the phenolic foam to be used possesses a rather low thermal conductivity with high K-factors in the range of generally about 0.19 to 0.22 in regard to such foams having a density from approximately 2.5 to 6.3 lb/ft$^3$ tested at 20° C. Said foam possesses relatively high water vapor transmission and absorption properties with the level of water vapor transmission decreasing as the density of the foam increases due to the partially closed cell structure which occurs as the foam density increases. The cells of low density phenolic foam are essentially completely open while high density foam usually contain closed cells in proportions up to 75% of the total cells. This lighter characteristic allows the porosity or permeability characteristics to be varied in the in situ cured structure as desired for dealing with particular local conditions which may be encountered at the subterranean site. The resulting cell structure is normally homogeneous and consists of more or less uniform extremely small spherical cells, whether opened or closed, a characteristic not associated generally with other cellular plastic or foam structure materials. Said characteristic contributes to the favorable mechanical strength and compared to rigidity of the in situ cured phenolic foam in question which is exhibited over the very broad range of vicinal temperatures and pressure which can be encountered at the subterranean site. Phenolic foams will last for the foreseeable lifetime of the in situ foam plug structures while exhibiting low detrimental settling or dusting due to the friable nature of the material. At the same time, the partially open cell structure of the phenolic foams allows them to enjoy higher K-factor and water absorption values than polyurethane foams.

By including volatile liquids as the foaming or blowing agents, the cell size and density of the in situ cured foam may be regulated with the cell size increasing and the density decreasing as the proportion of volatile liquid increases. The presence of the catalyst, e.g., acid activating catalyst such as any mineral acid, causes the foaming reaction to occur rapidly with typical cream times of one to two seconds and rise times of approximately 50 to 60 seconds. If the proportion or concentration of the catalyst is increased, the foam will set more rapidly and may set before full expansion of the foam can occur so as to provide a higher density. Regardless of the presence or absence of such volatile liquid, the presence of water as a solvent dilutant or condensation product will contribute to the degree of foam expansion in a direct proportion.

Additional additives including wetting agents or surfactants of conventional types and for conventional purposes may be included in the formulation. For example, one part of a wetting agent per hundred parts of curable resin formulation is sufficient to produce a coarse foam having large, thick walls. As the proportion of wetting agent or surfactant is increased, the resulting foam will increase in toughness and resiliancy while still possessing mechanical stability and being residually effective over all structural rigidity.

Finally, the in situ cured foam structure may be selectively mechanically modified to provide a protective hard phenolic skin surrounding a more friable rigid foam cure. Said modification may be accomplished by carrying the injection into a subterranean site having a correspondently lower vicinal temperature which may be lowered by conventional techniques such as exposing the vicinal subterranean site to a low temperature fluid which extracts the sensible heat from the area. For example, cryogenic application of selective quantities of sub-zero gas to the subterranean site immediately prior to the delivery of the foaming material can accomplish the desired objective. Said feature may be used in stabilizing formations outside the casing where structural support and other problems arise and where it is desirous to vary the permeability properties selectively in the cured foam structure or plug in relation to the particular production conditions. Depending upon the purpose to be served and the nature or condition of the underground deposit, more selective adjustment may be desired to regulate fluid flow between liquids and gases or between particular liquids.

A wide possibility of physical properties can be obtained from the in situ cured resin foam structure due to the permitted flexibility in proportioning the precursor ingredients and their reaction condition. Such permits selective recovery of producing oil or gas while preventing sand or other solid infiltration, permits structural stabilization of voids and surrounding formation areas, and enables squeeze material procedures to be carried forth for dealing with subterranean water shutoff or loss of circulation problems. These procedures are different from conventional procedures such as those dealing with the in situ setting of liquid or preformed resin foam or solid or resin-coated particles to be conveyed from the upper end of the well bore to the subterranean site.

While preferred embodiments of the present invention have been described for the purpose of disclosure, it is to be understood that the description and foregoing examples are given for the purposes of illustrating and explaining the invention, and suitable variations may be made within the scope of the appended claims without departing from the invention.

What is claimed is:

1. A method for treating a subterranean site in a well bore which comprises (a) locally injecting into the well bore at the subterranean site a selectively substantially occluding quantity of a foamable curable resin material which upon curing forms a substantially chemically and dimensionally stable permeable resin foam mechanically rigid occluding structure which is permeable to liquids and gases while effectively preventing the passage of subterranean solids therethrough, and (b) causing the injected resin foaming material to cure in situ at the subterranean site to form such porous resin foam structure thereat.

2. The method of claim 1 wherein (a) the well bore contains a casing having perforations for normally collecting subterranean fluid deposits along a zone at the subterranean site, and (b) the foamable curable resin material is locally injected into the casing at such zone to form such structure as an internal series of one or more permeable and impermeable plugs occupying at least the portion of such zone having such perforations.

3. The method of claim 1 wherein (a) the well bore contains a casing having perforations for normally collecting subterranean fluid deposits along a zone at the subterranean site, and (b) the foamable curable resin material is locally injected outwardly through such perforations to form such structure as an external permeable plug occupying at least the surrounding subterranean area adjacent such perforations.

4. The method of claim 1 wherein (a) a remotely actuable self-contained charger-mixer-injector device carrying a chargeable local supply of precursor ingredients for producing such curable foaming material in such occluding quantity is lowered through the well bore to the subterranean site, and (b) such charger-mixer-injector device is remotely actuated to charge, mix and inject such local supply thereat under selective operative elevated delivery pressure.

5. The method of claim 4 wherein (a) the charger-mixer-injector device is flow-connected through feed lines with a replenishing main supply of such precursor ingredients and gases and remotely located at the upper end of the well bore, and (b) such local supply is periodically replenished at the subterranean site from the main supply by such feed lines.

6. The method of claim 4 wherein (a) the well bore contains a casing, and (b) a dogging method is used for securing and stabilizing the charger-mixer-injector device with regard to the casing after said device has been lowered to its proper position within the casing.

7. The method of claim 6 wherein the dogging method includes (a) one or more dogging pads, and (b) a piston device which may be forced by gas or liquid pressure to translate, said translation forcing one or more dogging pads to move outwardly and away from the invention until they come in contact with the interior side of the casing at which point the dogging pads will remain until the pressure is released or until sufficient pressure is applied to the piston in the opposite direction.

8. The method of claim 4 wherein a downhole tool cooling method is used which includes (a) a high pressure cylinder for storing highly pressurized gas, (b) a metering valve for setting the flow rate of gas from the cylinder, (c) a wireline cable from the surface to the device, (d) a solenoid valve for controlling the escape of gas by command through the wireline cable, and (e) a check valve for preventing flow of contaminants back towards the cylinder.

9. The method of claim 1 wherein (a) the foamable curable resin material includes a foamable curable resin, a catalyst and a foaming agent therefore (b) such resin, catalyst and foaming agent are locally intermixed to generate such foaming material, and (c) said foaming material is injected as a flowable substantially uniformly consistent gas-liquid phase mixture at the subterranean site.

10. The method of claim 1 wherein the corresponding foamable curable resin material is a curable phenolic resin foam.

11. The method of claim 1 wherein the corresponding foamable curable resin material is a curable polystyrene resin foam.

12. The method of claim 1 wherein the corresponding curable resin foaming material is a curable polycomponent resin catalyst system capable of forming an in situ occluding structure which by its nature is a substantial foam medium.

13. A method for treating a subterranean site in a well bore to prevent the infiltration of subterranean solids into the well bore which comprises (a) locally generating and injecting, into the well bore from a source at the subterranean site of the solids infiltration, a selective substantially occluding quantity of a curable resin foaming material sufficient to plug the well bore at the desired location wherein the material, upon curing, forms a substantially chemically and dimensionally stable permeable resin foam mechanically rigid occluding structure which is permeable to liquids and gases while effectively preventing the passage of subterranean solids therethrough, and (b) causing the injected resin foaming material to cure in situ at the subterranean site to form such porous resin foam structure at said site.

14. The method of claim 13 wherein (a) the well bore contains a casing having perforations for normally collecting subterranean fluid deposits along a zone at the subterranean site of the infiltration of solids, and (b) the curable resin foaming material is locally injected in to the casing at such zone to form such structure as an internal plug occupying at least the portion of such zone having such perforations.

15. The method of claim 13 wherein the internal plug consists of one or more series of permeable and impermeable plugs.

16. The method of claim 13 wherein (a) a remotely actuable self-contained charger-mixer-injector device carrying a chargeable local supply of precursor ingredients for producing such curable foaming material in such occluding quantity is lowered through the well bore to the subterranean site, and (b) such charger-mixer-injector device is remotely actuated to charge, mix and inject such local supply thereat under selective operative elevated delivery pressure.

17. A method for treating a subterranean site in a well bore to prevent the infiltration of a subterranean solids into the well bore which comprises (a) locally generating and injecting, into the well bore from a source at the subterranean site of the solids infiltration, a selective substantially occluding quantity of a curable resin foaming material sufficient to plug the well bore at the desired location wherein the material, upon curing, forms a substantially chemically and dimensionally stable permeable resin foam mechanically rigid occluding structure which is permeable to liquids and gases while effectively preventing the passage of subterranean solids therethrough, and (b) mechanically blowing the resin catalyst material by the use of an inert gas which is supplied to and mixed with said material to form the mechanically permeable occluding structure.

18. A method for treating a subterranean site of a well bore to stabilize a subterranean void surrounding a portion of the well bore which compises (a) providing in the well bore a casing having perforations along a zone of the casing at the site of the subterranean void (b) locally generating and injecting outwardly through such perforations into the subterranean void from a source at the subterranean site, a selective substantially occluding quantity sufficient to fill and stabilize a portion of said void with a curable resin foaming material which upon curing forms a substantially chemically and dimensionally stable porous resin foam mechanically rigid occluding structure which is permeable to liquids and gases while effectively preventing passage of subterranean solids therethrough, and (c) causing the injected resin foaming material to cure in situ at the subterranean site to form such porous resin foam structure thereat.

19. The method of claim 18 wherein the cured resin foaming material provides structural stability to the casing thereat.

20. The method of claim 18 wherein (a) a remotely actuable self-contained charger-mixer-injector device carrying a chargeable local supply of precursor ingredients quantity is lowered through the well bore to the subterranean site, (b) a dogging method is used for securing and stabilizing the charger-mixer-injector device with regard to the casing after said device has been lowered to its proper position within the casing, (c) the device includes a sealing cone, and (d) such charger-mixer-injector device is remotely actuated to charge, mix and inject such local supply thereat under selective operative elevated delivery pressure outwardly through the perforations.

21. A charger-mixer-injector device for use in a well bore which comprises a self-contained suspended capsule adapted to be lowered through the well bore and having therein (a) means defining reservoirs for a chargeable supply of precursor ingredients for producing a curable rsin foaming material,
(b) mixing means for mixing the precursor ingredients,
(c) injector means for injecting the effluent from the mixing means into the well bore, and
(d) remotely actuable means for selectively charging said supply from the reservoirs to the mixing means and for operating the mixing means to intermix such supply to form the foaming material and in turn convey said foaming material to the injector means and for operatively positioning the injector means for injection of said foaming material from the capsule into the well bore.

22. The device of claim 21 wherein
(a) the means defining reservoirs includes:
(i) pressure tank for precursor ingredients to be intermixed and;
(ii) a pressure tank for charging the pressure fluid, and;
(b) the remotely actuable means include
(i) a charging pressure fluid supply arranged for supplying charging pressure fluid under charging pressure from the charging pressure fluid tank to the pressure tanks for the precursor ingredients to maintain the supply of precursor ingredients under common charging pressure corresponding to the pressure in the charging pressure fluid tank,
(ii) precursor ingredients supply valves arranged for supplying the precursor ingredients under charging pressure from the corresponding precursor ingredient tanks to the mixing means, and
(iii) an injector means control valve arranged for supplying pressure fluid under charging pressure from the charging pressure fluid tank to the injector means for operatively positioning the injector means in the well bore.

23. The device of claim 22 wherein the pressure tanks are operatively closably flow connected by way of feed lines with a replenishing main supply of such precursor ingredients located at the upper end of the well bore.

24. A charger-mixer-injector device for use in a well bore which comprises a self-contained suspended capsule adapted to be lowered through the well bore and having therein
(a) means defining reservoirs for a chargeable supply of precursor ingredients for producing a curable resin foaming material,
(b) mixing means for mixing the precursor ingredients,
(c) injector means for injecting the effluent from the mixing means into the well bore; and
(d) remotely actuable means for selectively charging said supply from the reservoirs to the mixing means for for operating the mixing means to intermix such supply to form the foaming material and in turn convey said foaming material to the injector means and for operatively positioning the injector means for injection of said foaming material from the capsule into the well bore, wherein the capsule is operatively flow connected by way of feed lines with a replenishing supply of the precursor ingredients which are located at or above the surface end of the well bore.

25. The device of claim 21 wherein
(a) the mixing means includes an impeller in a mixing chamber in operative flow communication upstream with teh valve means and downstream with the injector means,
(b) the injector means includes a nozzle in operative form communication upstream with the mixing means and downstream with the exterior of the capsule,
(c) the remotely actuable means includes valve means arranged for selectively charging the supply from the means defining reservoirs to the mixing means.

26. The device of claim 25 wherein
(a) the capsule is elongated with check valve equipped feed line connector means which are provided at the upper end portion of the capsule for closeably flow connecting the means defining reservoir by way of feed lines with a replenishing main supply of such precursor ingredients remotely located at the upper end of the well bore, and
(b) a portion of the nozzle defining an exit valve extends outwardly at the lower end portion of the capsule.

27. A method for treating a subterranean site in a well bore which comprises
injecting into the well bore at the subterranean site a substantially occluding quantity of a curable resin material foam which upon curing forms a substantially chemically and dimensionally stable permeable resin foam mechanically rigid occluding structure which is permeable to liquids and gases while effectively preventing the passage of subterranean solids therethrough.

28. A method for treating a subterranean site in a well bore to prevent the infiltration of subterranean solids into the well bore which comprises
locally generating and injecting, into the well bore from a source at the subterranean site of the solids infiltration, a selective substantially occluding quantity of a curable resin foaming material sufficient to plug the well bore at the desired location wherein the material, upon curing, forms a substantially chemically and dimensionally stable permeable resin foam mechanically rigid occluding structure which is permeable to liquids and gases while effectively preventing the passage of subterranean solids therethrough.

29. A charger-mixer-injector device for use in a well bore which comprises a self-contained suspended capsule adapted to be lowered through the well bore and having therein
(a) means defining reservoirs for a chargeable supply of precursor ingredients for producing a curable resin foaming material,
(b) mixing and injector means for mixing the precursor ingredients and injecting the mixed precursor ingredients into the well bore, wherein the capsule is operatively flow connected by way of feed lines with a replenishing supply of the precursor ingredients which are located at or above the surface end of the well bore.

* * * * *